United States Patent [19]

Warren

[11] Patent Number: 4,718,250

[45] Date of Patent: Jan. 12, 1988

[54] COMPACT HEAT EXCHANGER FOR REFRIGERATION SYSTEMS

[76] Inventor: James Warren, 576 Maple Ave., Teaneck, N.J. 07666

[21] Appl. No.: 681,370

[22] Filed: Jul. 7, 1986

[51] Int. Cl.[4] ..... F25B 47/00

[52] U.S. Cl. ..... 62/278; 62/513; 62/83

[58] Field of Search ..... 62/513, 503, 83, 514, 62/498, 278, 151, 159

[56] References Cited

U.S. PATENT DOCUMENTS

| | | | |
|---|---|---|---|
| 2,120,764 | 6/1938 | Newton | 62/83 |
| 2,472,729 | 6/1949 | Sidell | 62/83 |
| 4,488,413 | 12/1984 | Bottom | 62/513 |

*Primary Examiner*—Henry A. Bennet
*Attorney, Agent, or Firm*—Michael J. McGowan; Arthur A. McGill; Prithvi C. Lall

[57] ABSTRACT

A compact refrigeration heat exchanger comprising coiled tubing wrapped around a cylindrical chamber having input and output ports for preheating the evaporatior output to superheat liquid refrigerant prior to the compressor inlet by passing hot gas from the compressor output back through the coil while low pressure refrigerant flows through the chamber. The heat exchanger enables a refrigeration system to be defrosted without liquid refrigerant flood back to the compressor. Any liquid remaining accumulates in the heat exchanger due to the different lengths of the tubing in the heat exchanger.

5 Claims, 3 Drawing Figures

COMPACT HEAT EXCHANGER FOR REFRIGERATION SYSTEMS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to refrigeration systems and more particularly to a compact heat exchanger which acts to prevent liquid refrigerant carry-over into the suction side of a low temperature refrigeration system compressor during defrosting of the evaporator coils.

(2) Description of the Prior Art

It is well known that present defrosting procedures require a skilled operator and even then some liquid floodback occurs which, upon reaching the compressor inlet, causes significant damage. Damaged units result in extended periods of system shut-down and potential loss of the contents stored within.

SUMMARY OF THE INVENTION

Accordingly, it is a general purpose and object of the present invention to provide heat exchanging means for vaporizing any liquid floodback prior to it reaching the compressor inlet. It is a further object that such heat exchanger be compact in size. Another object is that the heat exchanger be capable of use during defrost and normal system operations.

These objects are accomplished with the present invention by providing a compact refrigeration heat exhanger comprising coiled metal tubing wrapped around and fixedly attached to a cylindrical metal chamber having input and output ports for preheating the evaporator output in order to superheat any refrigerant in the liquid state to vaporize it prior to the compressor inlet by passing hot gas from the compressor outlet back through the coiled tubing while low pressure refrigerant flows through the chamber. The heat exchanger enables a refrigeration system to be defrosted without having liquid refrigerant flood back reach the compressor. Any entrained liquid not vaporized accumulates in the bottom of the heat exchanger chamber due to the different lengths of the input and output standpipe tubes of the heat exchanger.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
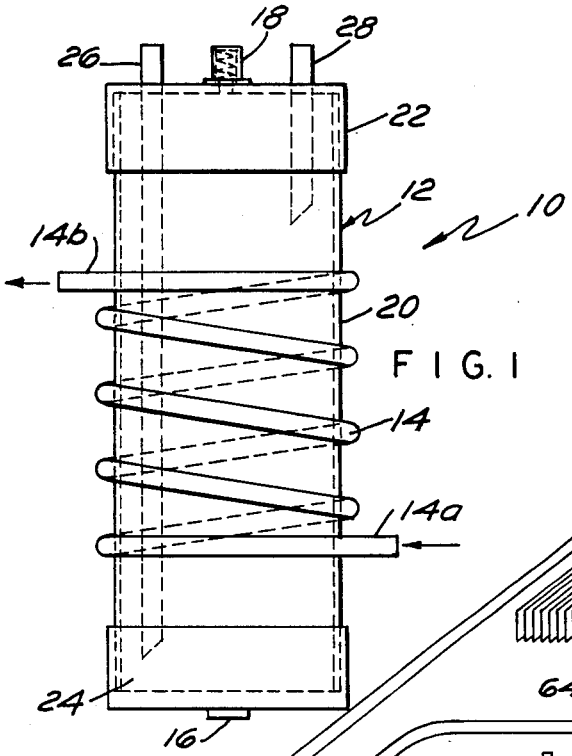
FIG. 1 shows a compact heat exchanger according to the present invention.

Referring now to FIG. 1 there is shown a compact heat exchanger 10 according to the present invention.

The purpose of heat exchanger 10 is, when used in conjunction with a conventional vapor/compression cycle refrigeration system, to prevent any refrigerant in the liquid state from the system evaporator outlet from carrying over into the suction side of the refrigeration system compressor where it would cause significant damage. Heat exchanger 10 comprises an enclosed pressure vessel 12 with a coiled metal tubing/discharge line 14 wrapped around the outer diameter thereof so as to, when carrying hot gas within, pre-heat and vaporize any entrained liquid refrigerant before it enters the compressor. A manual drain fitting 16 is provided to drain entrapped sediment and/or oil from the bottom of vessel 12. Further, because heat exchanger 10 operates under pressure, a fusible plug 18 is fitted in the top of vessel 12 to provide overpressure and overheat protection. Vessel 12 further comprises a cylindrical metal body 20 of preselected wall thickness having first and second metal end caps 22 and 24 enclosing the top and bottom ends of body 20 respectively. Body 20 and end caps 22 and 24 may be of copper or other high conductivity metal. Drain plug 16 is centrally located in bottom end cap 24, which end cap is fixedly attached to body 20 around the periphery thereof by a solder joint or the like. Top end cap 22 is also fixedly attached to body 20 at the cylinder end diametrically opposite end cap 24. Cap 22 further has a fusable plug 18 centrally located thereupon and also has a low pressure inlet tube 26 and a low pressure outlet tube 28 passing through top end cap 22 and into the vessel interior, tubes 26 and 28 being fixedly attached to end cap 22 by a solder joint or the like. Tube 26 extends almost down to bottom end cap 24 while tube 28 terminates just inside end cap 22. Coiled line 14 further includes an inlet end **14*a* located near the bottom of vessel 12 and an outlet end 14*b* near the top of the vessel. Line 14 is fabricated from metal tubing of copper or the like which is conductively attached to the outer surface of body 20** such as by soldering.

Figure 2:
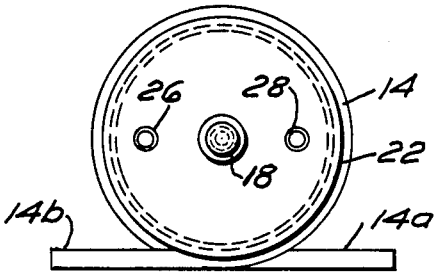
FIG. 2 shows a top view of the device of FIG. 1.

FIG. 2 is a top view of the heat exchanger of FIG. 1 showing the central location of fusable plug 18 and the relative positions of tubes 26 and 28 which lie on a diameter of cap 22 and are spaced a preselected distance apart. Tube ends **14*a*** and *b* are shown to align tangentially but any other suitable alignment may be selected without deviating from the teachings of the present invention.

Figure 3:
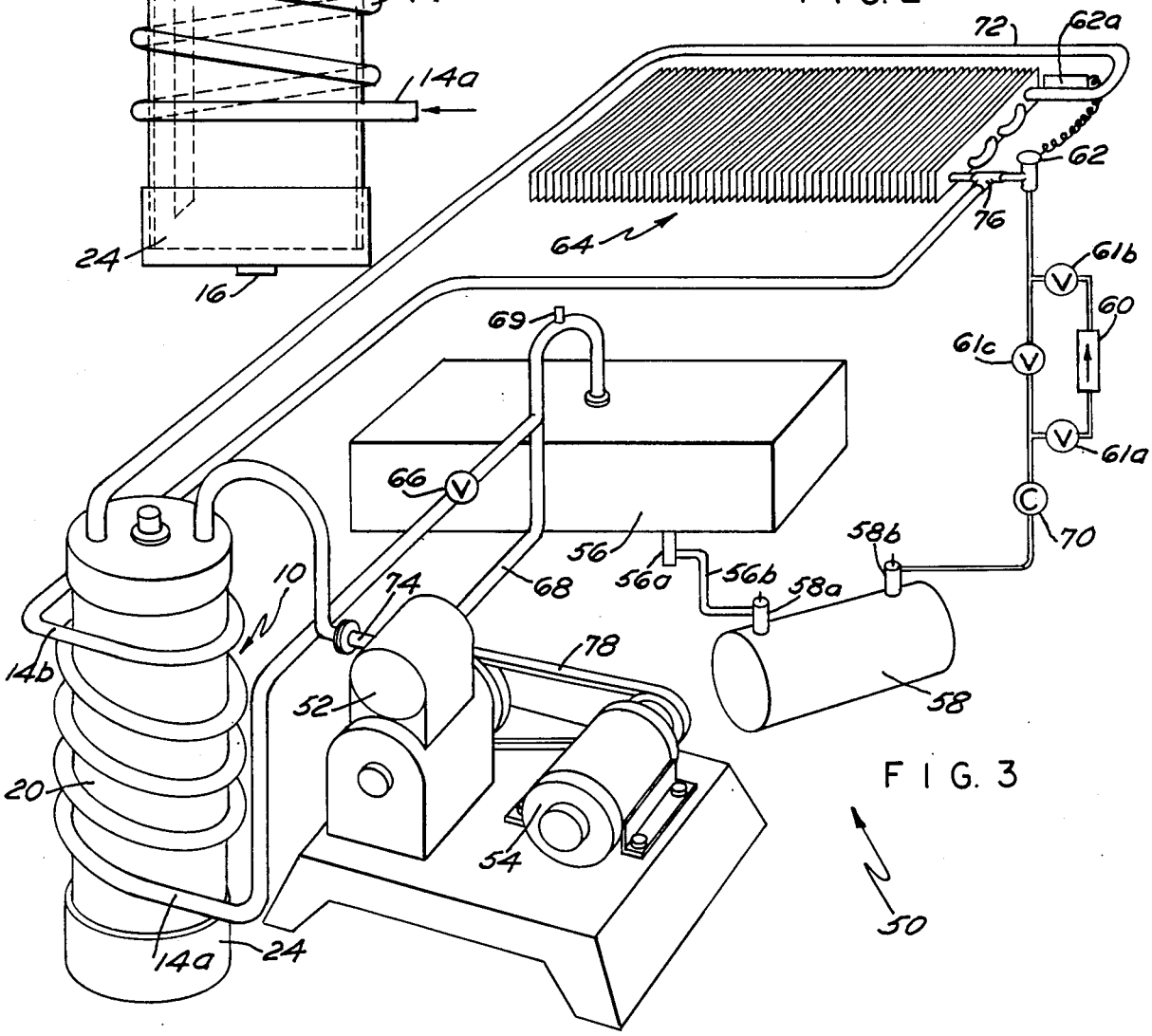
FIG. 3 shows a refrigeration system which includes the device of FIG. 1.

FIG. 3 shows a conventional refrigeration system 50, operating in a well known fashion, and further including heat exchanger 10. System 50 further comprises a compressor 52 driven by an electric motor 54, a water cooled condenser 56, a receiver 58, a drier 60, drier inlet, outlet and bypass valves **61*a*, *b*,** and *c*, respectively, a thermostatic expansion valve 62 with power element **62*a*, and an evaporator coil 64 together with interconnecting tubing and control valves. In operation, during the normal refrigeration cycle, a defrost hand valve 66 is in the closed position. The hot refrigerant in compressor discharge line 68 flows through condenser 56, where it loses its heat of compression and its latent heat of condensation, condensing into a high pressure liquid. A purge valve 69 is provided in discharge line 68 at the high point of the system. This liquid then flows, via condensor outlet valve 56*a*, and outlet line 56*b*, to receiver inlet valve 58*a*, through receiver 58, then out through "King Valve" 58*b* and sight glass 70. Valve 61*c* is normally closed and valves 61*a*** and *b* are open such that the high pressure liquid then flows into system dehydrator 60, and then through the thermostatic expansion valve 62 and into evaporator 64. In the coils of evaporator 64, the low pressure refrigerant boils, absorbing the latent heat of evaporation from the refrigerated load. At evaporator outlet line 72 sufficient superheat is maintained to ensure that only low pressure, superheated vapor is admitted to compressor inlet 74.

During the defrost mode, defrost hand valve 66 is opened, permitting hot, high pressure refrigerant gas to flow through line 14, heating the outside of heat exchanger 10. After flowing through tubing 14 sufficient heat remains to permit entry of high pressure, high temperature refrigerant to evaporator inlet tee 76, downstream of the thermostatic expansion valve 62 outlet. This hot vapor flows through and melts any ice and frost from the surfaces of evaporator 64. During this process, the ice and frost absorb the latent heat of condensation from the refrigerant and therefore some liquid refrigerant may be present at evaporator outlet and suction line 72. This mixed phase fluid would cause extensive damage to compressor 52 if allowed to enter suction line 72. When heat exchanger 10 is in operation any entrapped low-to-medium pressure R-12 liquid refrigerant must pass through the long and short heated standpipes of the heat exchanger. The addition of this device allows routine defrosting to be performed in a manner that minimizes any possibility of compressor damage by mixed-phase carryover.

The key advantage of the compact heat exchanger over the manual defrost method is that the possibility of floodback and ensuing damage is eliminated.

What has thus been described is a compact refrigeration heat exchanger comprising coiled tubing wrapped around a cylindrical chamber having input and output ports for preheating the evaporator output to superheat liquid refrigerant prior to the compressor inlet by passing hot gas from the compressor output back through the coil while low pressure refrigerant flows through the chamber. The heat exchanger enables a refrigeration system to be defrosted without liquid refrigerant flood back to the compressor. Any liquid remaining accumulates in the heat exchanger due to the different lengths of the standpipe tubing in the heat exchanger.

Obviously modifications and variations of the present invention may become apparent in light of the above teachings. For example: the tubing and pressure vessel materials and dimensions may be varied to suit intended system configurations. Also, the relative angular positions of the heat exchanger inlet and outlet coil ends may be varied to suit the particular application.

In light of the above, it is therefore understood that within the scope of the appended claims, the invention may be practiced otherwise than as specifically described.

What is claimed is:

1. In combination with a vapor/compression refrigeration system, a defrosting apparatus for receiving mixed phase refrigerant emanating from the system evaporator outlet during system defrost, and transmitting only superheated gaseous refrigerant to the system compressor inlet, said defrosting apparatus comprising:

a cylindrical metal body having a preselected length, diameter and wall thickness, and top and bottom ends;

a metal defrost tube means having a first tube end, a second tube end, a plurality of helical tubular coils formed therebetween and a defrost valve, said defrost valve outlet being fixedly attached to said second tube end, the inlet of said defrost valve being fixedly attached to the outlet of said compressor, said first tube end being fixedly attached to said evaporator inlet, and said tube coils further being disposed about and fixedly attached to the outside surface of said body, for receiving high temperature, high pressure gaseous refrigerant from said compressor outlet upon opening of said defrost valve and transmitting said high pressure gaseous refrigerant therethrough to said evaporator inlet such that heat from said refrigerant gas is transmitted from said coils, through said wall thickness and into the interior of said body;

a first metal end cap, fixedly attached to said bottom end of said body, for sealably enclosing said bottom end;

a second metal end cap, fixedly attached to said top end of said body, for sealably enclosing said top end thereby forming, in cooperation with said first cap, a chamber therewithin;

a first metal standpipe tube, passing through and fixedly attached to said second end cap, and extending a first preselected depth into said chamber, for receiving said mixed phase refrigerant from said evaporator outlet and transmitting said mixed phase refrigerant into said chamber, said mixed phase refrigerant absorbing said heat transmitted therein from said coil and transforming said mixed phase refrigerant into superheated low pressure refrigerant gas; and a second metal standpipe tube, passing through and fixedly attached to said second end cap, and extending a second preselected depth into said chamber, said first depth of said first standpipe being substantially greater than said second depth, for receiving and transmitting only said superheated refrigerant to said compressor inlet.

2. A defrosting apparatus according to claim 1 wherein said first end cap further comprises drain plug means passing therethrough, for draining any oil and sediment from the bottom of said chamber.

3. A defrosting apparatus according to claim 2 wherein said second end cap further comprises pressure relief plug means, for providing high pressure protection to said chamber.

4. A defrosting apparatus according to claim 3 wherein said body, said discharge tube, said first and second end caps, and said first and second standpipe tubes are of copper.

5. A defrosting apparatus according to claim 4 wherein said fixed attachments between said body and said end caps, said body and said discharge tube, and said end caps and said standpipes are solder joints.

* * * * *